United States Patent [19]

Koepke

[11] 4,173,166

[45] Nov. 6, 1979

[54] TAB SWITCH MECHANISM FOR MUSICAL INSTRUMENTS

[75] Inventor: Donald B. Koepke, Franklin Park, Ill.

[73] Assignee: Thomas International Corporation, Chicago, Ill.

[21] Appl. No.: 848,891

[22] Filed: Nov. 7, 1977

[51] Int. Cl.[2] ..... G10B 3/10; H01H 9/26

[52] U.S. Cl. ..... 84/343; 84/DIG. 7; 200/5 B

[58] Field of Search ..... 200/5 R, 5 A, 5 B, 5 C, 200/5 D, 5 E, 18, 318–328, 329, 330, 335, 339; 84/DIG. 7, 423, 341, 345, 343, 369

[56] References Cited

U.S. PATENT DOCUMENTS

| | | | |
|---|---|---|---|
| 2,491,168 | 12/1949 | Dusek | 200/5 E |
| 3,071,659 | 1/1963 | Kimball | 200/18 X |
| 3,084,584 | 4/1963 | Iorio | 84/1.17 |
| 3,136,869 | 6/1964 | Haviland | 200/5 C |
| 3,283,087 | 11/1966 | Appel | 200/5 B |
| 3,306,995 | 2/1967 | Campbell | 200/18 |
| 3,420,131 | 1/1969 | Thomas et al. | 84/345 |
| 3,420,969 | 1/1969 | Edwards et al. | 200/328 X |

FOREIGN PATENT DOCUMENTS

| | | | |
|---|---|---|---|
| 1146161 | 3/1963 | Fed. Rep. of Germany | 200/320 |
| 1269702 | 6/1968 | Fed. Rep. of Germany | 200/5 B |
| 1761 | 8/1889 | Sweden . | |
| 968934 | 9/1964 | United Kingdom | 200/328 |

*Primary Examiner*—James R. Scott

*Attorney, Agent, or Firm*—Wegner, Stellman, McCord, Wiles & Wood

[57] ABSTRACT

An improved switch mechanism for controlling the actuation of a plurality of electrical switches by means of tablets of a musical instrument, such as an organ. The mechanism permits a plurality of tablets to be depressed simultaneously and releasably retained in the depressed position so as to maintain a selected actuation of switches such as for providing selected voicing circuits in an organ. The mechanism is arranged to cause an automatic release of any previously depressed tablet as an incident of the user depressing subsequently one or more tablets to the switch actuating position. The tablets may be biased to the switch releasing position with the mechanism permitting the biasing structure to return the tablets to the switch releasing position as an incident of such further tablet depression.

10 Claims, 7 Drawing Figures

TAB SWITCH MECHANISM FOR MUSICAL INSTRUMENTS

BACKGROUND OF THE INVENTION

1. Field of the Invention

This invention relates to musical instruments and in particular to switching mechanism for use in controlling electrical switches utilized in such musical instruments.

2. Description of the Prior Art

It is conventional in musical instruments, such as electronic organs, to utilize a plurality of stop tablets for controlling tone characteristics produced by the organ. Illustratively, such stop tablets are provided for introducing clarinet effects, trumpet effects, etc.

At times, it is desirable to utilize two such effects, or characteristics, concurrently. Thus, it is desirable to provide means for maintaining one or more of the tablets depressed as desired by the player of the instrument.

It is further desirable in such material instruments to cause the release of a previously selected tablet when a newly selected tablet is depressed. It is desirable that such release be effected without the need for manipulation of the previously selected tablets.

One organ structure providing stop tablet control of the tone selection is illustrated in U.S. Pat. No. 3,136,869 of Lyman J. Haviland. As shown therein, operation of any tablets causes a pivoting of a rocker arm to engage any one of a plurality of plungers which may have been previously placed in an operated position. The engagement effects a return of the plungers to a normal position under the pressure of a number of arms provided in the apparatus. The plungers, on returning to their normal position, align with detent portions on spring blades of the apparatus to permit the blades to disengage and interrupt any circuit previously completed thereby.

In U.S. Pat. No. 3,084,584 of Amedeo Iorio, an electrical musical instrument comprising an accordian-organ combination is shown having a plurality of organ stop flaps provided with switch means. Each flap is pivoted on a suitable pivot pin and mechanically linked to the vent shutters of the keyboard. A leaf spring is provided for restoring a bar flap whenever another key is depressed. The flap actuates three-pole switches. The flap is retained in a depressed position by a leaf spring engaging a recess to hold the flap in the depressed position until a counter-vailing force is brought to bear thereagainst as by depression of another flip.

Howard M. Thomas et al, in U.S. Pat. No. 3,420,131, disclose a stop tablet assembly having a rock shaft on which the stop tablets are mounted for selective movement between first and second positions. A plurality of cams are mounted on a cam shaft to be engaged with projections extending from the stop tablets. Upon movement of the cam shaft, the cams are moved against all of the stop tablets in the second position which are thereby returned to the first position. Operation of the rock shaft causes the operators aligned with a respective stop tablet setting means to move the tablet from the first to the second position.

In U.S. Pat. No. 3,306,995, Donald J. Campbell shows a switch control having release means mounted on a frame and normally positioned to be contacted by any one of a plurality of actuators when any one of the actuators is in a second position. Resultingly, movement of any one actuator into an override position enables biasing means of the mechanism to move all other actuators to the first position. The device is directed to the control of double touch actuation and more specifically utilizes felt pads which may move upwardly through an aperture in a base plate to permit an upward movement of a bar member for raising detent springs away from a plurality of tab pins to release the detent action whereby all tabs except the tab being actuated are released from the "on" position.

Swedish Pat. No. 1,761 shows a tab control wherein a manually operable pushbutton G is arranged to release an arm E thereby to release the tabs.

SUMMARY OF THE INVENTION

The present invention comprehends an improved musical instrument switch mechanism which is extremely simple and economical of construction while yet providing the highly improved selective tablet control discussed above.

More specifically, the invention comprehends the provision of such an improved switch mechanism in a musical instrument having a plurality of electrical switches, and a plurality of tablets having switch actuating means mounted for selectively actuating the respective electrical switches and defining switch actuating and switch releasing positions. The mechanism includes a plurality of cam followers associated one each with the tablets, means for urging each tablet to its switch releasing position, a plurality of cams mounted for joint movement adjacent the tablets and disposed for engagement one each with the cam followers, and means for urging the cams into engagement with the cam followers, the cams being configured so that movement of any tablet between the positions releases any other tablet in the switch actuating position to be returned by the urging means to its switch releasing position.

In the illustrated embodiment, the cams are formed integrally with a common carrier member which may comprise a pivotally mounted latch bar.

The biasing of the cams may be effected by means biasing the carrier, and in the illustrated embodiment, the biasing means comprises a tension spring controlling the pivotal disposition of the carrier.

The tablet biasing means and the cam biasing means may be correlated to permit a plurality of tablets to be retained in their switch actuating positions by the switch mechanism as an incident of concurrent movement of the plurality of tablets from the switch releasing positions thereof to the switch actuating positions thereof.

In one form, the tablet biasing means may comprise the means for biasing the switches.

In the illustrated embodiment, the cam followers are formed integrally with the tablets and the cams are formed integrally with the carrier.

The cams may be deformed on the carrier so as to permit any one of the cams to be disposed in an inactive arrangement so that actuation of the tab will have no effect on or not be effected by actuation of the other tabs.

In the illustrated embodiment, the cams are defined by a high portion and first and second low portions of the cams defining means. The cam followers are disposed at the first low portion in the switch releasing position of the tablet, at the second low portion in the switch actuating position of the tablet, and in engagement with the high portion during movement of the tablet between the switch releasing and switch actuating positions.

The second low portion of the cam effectively defines a recessed detent for releasably receiving the cam follower.

In the illustrated embodiment, the cams comprise a plurality of formed fingers mounted to a common carrier in side-by-side series relationship, and more specifically, comprise integral portions of the carrier.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
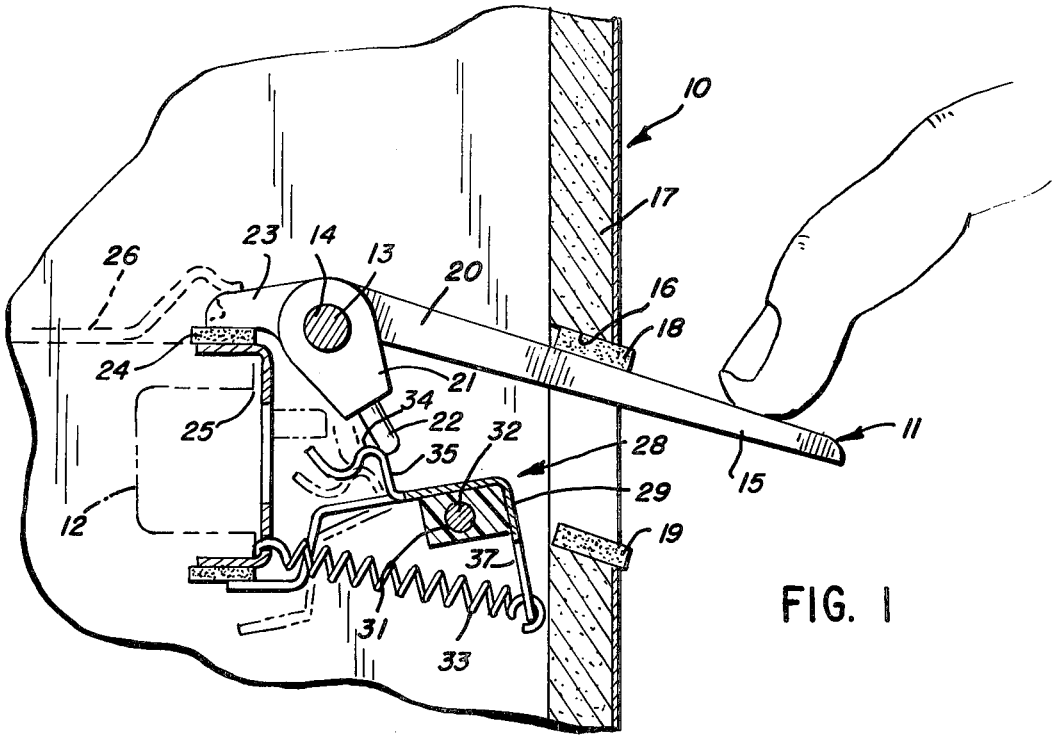
FIG. 1 is a fragmentary side elevation of a switch mechanism embodying the invention with portions of the musical instrument in which the switch mechanism is provided being shown in vertical section.

In the exemplary embodiment of the invention as disclosed in the drawing, a musical instrument structure generally designated 10, such as an electronic organ, is provided with a plurality of tablets generally designated 11. The tablets control a corresponding plurality of switches 12 as for controlling tone characteristics, or effects, in the playing of the musical instrument.

The plurality of tablets may be pivotally mounted about a common axis 13 on a pivot shaft 14. Each of the tablets, as shown in FIG. 1, includes a manual operating portion 15 projecting forwardly through an opening 16 in a wall portion 17 of the musical instrument. At the top of opening 16, a pad 18 may be provided, and at the bottom of the opening, a pad 19 may be provided for providing a resilient limit to the movement of the tablet operating portion 15.

The inner portion 20 of each tablet is provided with an integral mounting portion 21 carrying a cam follower 22.

The distal end 23 of the tablet is arranged to engage a pad 24 carried on a support 25 and cooperating with the pad 18 in limiting the movement of the tablet to the switch releasing position of FIG. 1. As shown in dotted lines in FIG. 1, a leaf spring 26 may be provided for biasing the tablet to the switch releasing position. Alternatively, as shown in FIG. 2, switch 12 may be provided with a spring biased actuator 27 which is engaged by the tablet portion 21 in the switch actuating position and which thus serves as means for biasing the tablet toward the switch releasing position of FIG. 1.

Figure 3:
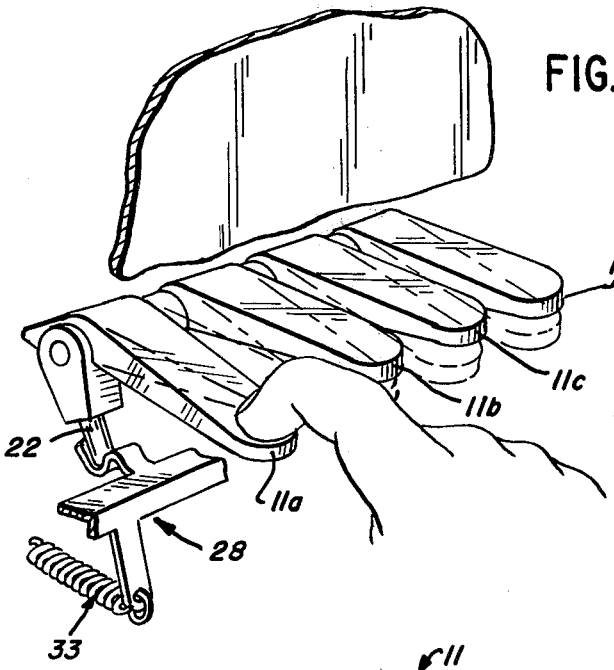
FIG. 3 is a fragmentary perspective view illustrating the arrangement of the tablet and switch mechanism upon depression of a selected tablet.
Figure 5:
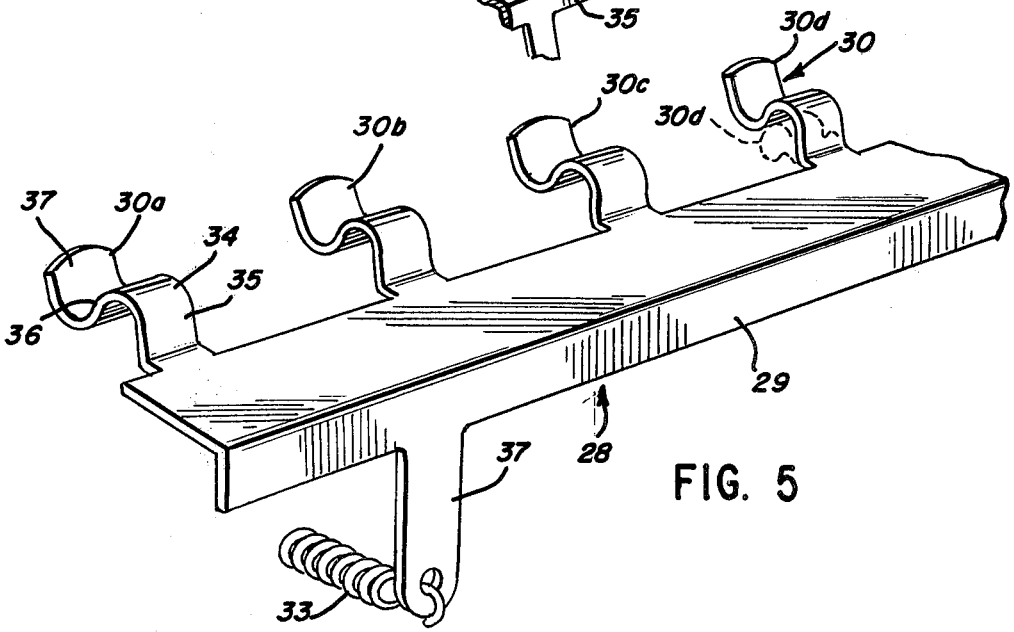
FIG. 5 is a fragmentary perspective view of the cam means of the mechanism with one of the cams being shown in a deformed arrangement in dotted lines, such as for causing a selected one of the cams to be inoperative in the functioning of the mechanism.

Control of the selective positioning of the tablets is effected herein by means of a cam device generally designated 28. As shown in FIG. 5, the cam device includes a latch bar, or carrier, portion 29 carrying a plurality of cams generally designated 30. Illustrated in FIG. 5 are four such cams identified as cams 30*a*, 30*b*, 30*c*, and 30*d*, respectively. The cams are associated with each of the tablets which, as shown in FIG. 3, may comprise tablets 11*a*, 11*b*, 11*c*, and 11*d*, respectively. Each of the cams and tablets are similarly constructed and the operation of the mechanism is effected similarly by the operation of any one of the cooperating tablet and cam combinations.

Figure 2:
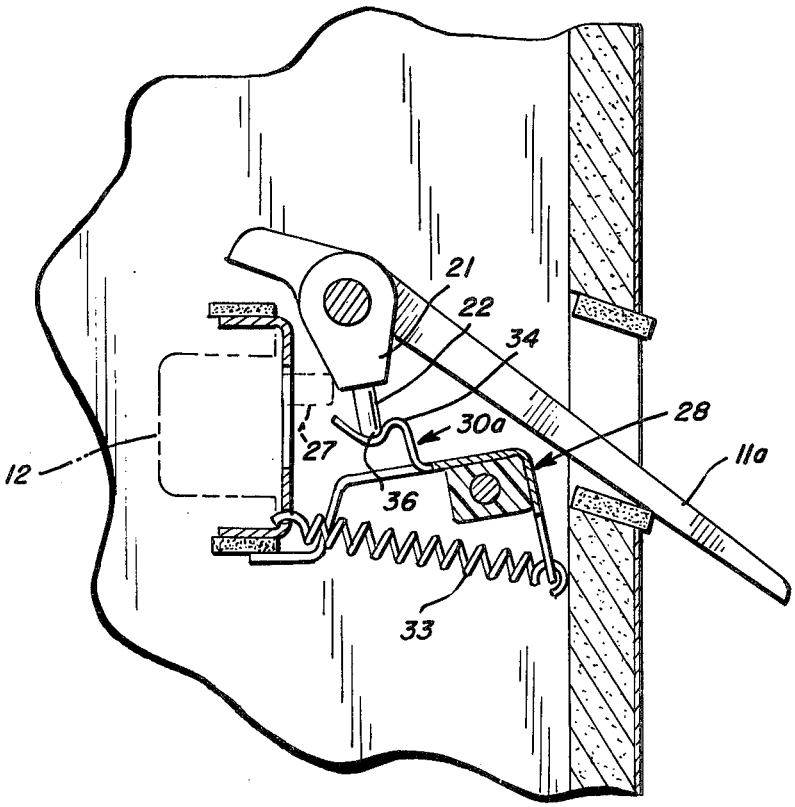
FIG. 2 is a view similar to that of FIG. 1 but with the tablet in a depressed, switch actuating position.

As shown in FIGS. 1 and 2, the latch bar is pivotally mounted to a pivot shaft 31 for pivoting about an axis 32 parallel to axis 13 of the tablet shaft 14. The latch bar may include a depending tab 37. A tension spring 33 may be connected between the distal end of the tab and the support 25 for biasing the cam 28 in a clockwise direction, as seen in FIGS. 1 and 2. Thus, as will be obvious to those skilled in the art, spring 33 also serves to bias the tablets in a counterclockwise direction about axis 13 as a result of the engagement of the cams with the cam followers 22 of the tablets.

As shown in FIG. 5, each of the cams 30 includes a high portion 34, a first low portion 35, and a second low portion 36. Second low portion 36 effectively defines a recess detent wherein the portion of the cam spaced from high portion 34 is defined by an upstanding distal end 37 of the cam. Thus, as shown in FIG. 2, when the cam follower 22 is received in the detent recess defined by the low portion 36 of the cam, the tablet is retained in the switch actuating position wherein the tablet portion 21 urges the switch actuator 27 inwardly. Spring 33 effectively maintains the cam follower in the recess by the upward uring of the cam portion 36 against the cam follower, as shown in FIG. 2.

In the switch releasing position of FIG. 1, the tablet is arranged so that the cam follower 22 is disposed at the low portion 35 of the cam. When the tablet is depressed, the cam follower 22 bears against the high portion 34 so as to move the high portion downwardly, as shown in broken lines in FIG. 1, until the cam follower passes high portion 34 to be received in the low portion recess 36, as shown in FIG. 2.

Figure 3A:
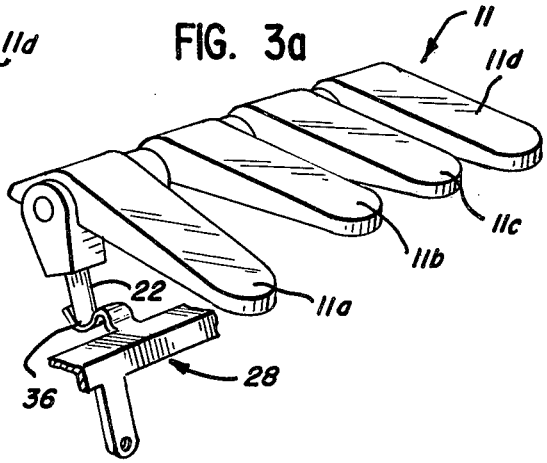
FIG. 3*a* is a fragmentary perspective view illustrating the arrangement of a plurality of the tablets upon release of the selected tablet in the switch actuating position.

Such pivotal movement of the cam device 28 causes each of the cams 30*a*, 30*b*, 30*c*, 30*d*, etc., to be similarly moved downwardly to the same extent as the cam engaged by the follower of the depressed tablet. Thus, any tablet which has been previously depressed and is being retained in the switch actuating position of FIG. 2, will be automatically released by the subsequent depression of a tablet, as shown in FIG. 1, as the cam associated therewith will be lowered to the same amount as the cam associated with the tablet being depressed as the follower 22 of the tablet being depressed moves over the high portion 34 of its associated cam. Resultingly, all previously depressed tablets being retained in the switch actuating position are automatically and instantaneously released by the depression of the subsequent tablet permitting the spring means 26, 27 and/or 33, to restore the previously depressed tablet to the released position of FIG. 1 so that only the subsequently depressed tablet, such as tablet 11*a* in FIG. 3, remains depressed as shown in FIG. 3*a*.

Figure 4:
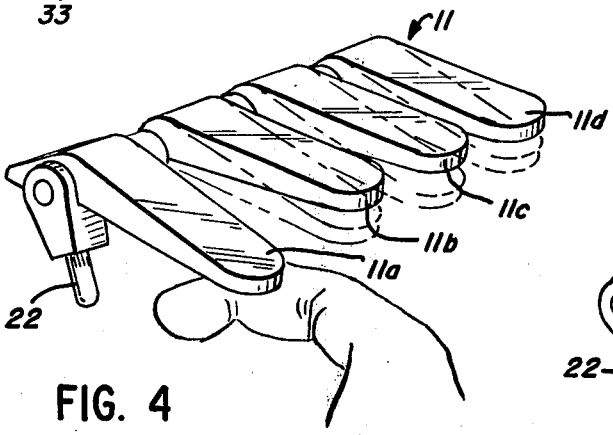
FIG. 4 is a fragmentary perspective view illustrating the movement of a selected tablet from a switch actuating position as by the upward urging of the tablet by the user's finger.
Figure 4A:
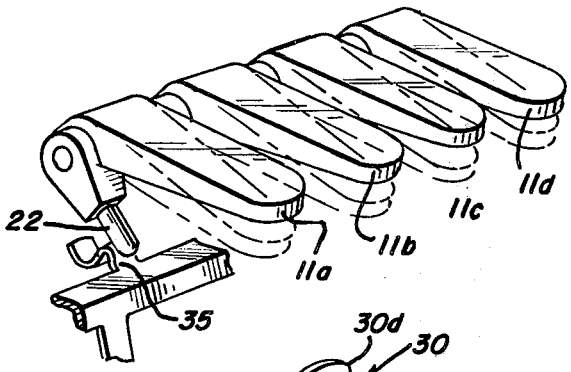
FIG. 4*a* is a fragmentary perspective view illustrating the arrangement of the tablets in the switch releasing position in full lines and in the switch actuating position in dotted lines.

If it is desired to return a tablet to the switch releasing position of FIG. 1 without depressing any subsequent tablet, the user may effect such movement by manipulation of the depressed tablet, as shown in FIG. 4, wherein the user's finger is brought to bear against the underside of the tablet so as to move the tablet upwardly against the retaining action of the spring means. Thus, as shown in FIG. 4*a*, upon such upward movement of the tablet, the cam follower 22 associated therewith is brought back to the low portion 35 of the associated cam whereby each of the tablets is now restored to the switch releasing position of FIG. 4*a*.

As shown in FIG. 5, if for any reason it is desired to preclude the automatic operation discussed above with respect to any of the tablets, the cam associated therewith may be deformed from the full line position shown in FIG. 5 so as to preclude the engagement of the cam with the tablet cam follower. Thus, as shown in FIG. 5, in dotted lines, cam 30*d* may be selectively downwardly deformed so as to prevent such automatic operation. As the cams are formed integrally with the carrier 29 and define tonguelike projections thereon, the cams may be adjusted for accurate operation relative to cam followers as well as for inactive disposition as discussed above.

In the illustrated embodiment, the spring means 26, 27 and 33 are correlated so that the mechanism may retain as many as three tablets concurrently in the switch actuating disposition of FIG. 2. Such concurrent switch actuation may be effected by the concurrent depression of the three selected tablets whereby each of the tablets is brought to the switch actuating disposition of FIG. 2 to be retained in the recess 36 of the respective cams. However, the subsequent depression of any one or more of the other tablets automatically effects a release of all of the previously depressed and retained tablets so that only the last depressed tablet or tablets will remain in switch actuating disposition and all other previously depressed tablets will be restored to the switch releasing disposition of FIG. 1.

The foregoing disclosure of the specific embodiment is illustrative of the broad inventive concepts comprehended by the invention.

The embodiments of the invention in which an exclusive property or privilege is claimed are defined as follows:

1. In a musical instrument having a plurality of electrical switches, and a plurality of tablets having switch actuating means mounted for selectively actuating the respective electrical switches and defining switch actuating and switch releasing positions, an improved switch mechanism comprising:

a plurality of cam followers associated one each with said tablets;

biasing means for urging each said tablet to its switch releasing position;

a plurality of cams;

a pivotally mounted carrier resiliently supporting said cams for joint movement adjacent said tablets to have engagement one each by said cam followers, said tablets being held releasably in said switch actuating position as an incident of engagement of the cam followers thereof with said cams, said cams defining a high portion and first and second low portions at opposite sides of said high portion, said cam followers being disposed at said first low portion in the switch releasing position of the tablet, at said second low portion in the switch actuating position of the tablet, and in engagement with said high portion during movement of the tablet between said positions; and spring means biasing said carrier for selectively urging said cams into engagement with said cam followers, said cams and cam followers being correlated so that movement of any selected tablet from either of said positions to the other of said positions releases any other tablet in the switch actuating position to be returned by said biasing means to its switch releasing position as an incident of the cam follower of the selected tablet engaging said high portion of its associated cam during said movement.

2. The musical instrument structure of claim 1 wherein said cams are formed integrally with said carrier.

3. The musical instrument structure of claim 1 wherein said tablet biasing means and said cam spring means are correlated to permit a plurality of tablets to be retained in the switch activating position by said switch mechanism as an incident of concurrent movement of said plurality of tablets from said switch releasing position to said switch actuating position thereof.

4. The musical instrument structure of claim 1 wherein said tablet biasing means comprises means for biasing said switches to a released position.

5. The musical instrument structure of claim 1 wherein said cam followers are integral with said tablets.

6. The musical instrument structure of claim 1 wherein one of said cams is disposed to be inoperative relative to its associated tablet and cam follower.

7. The musical instrument structure of claim 1 wherein said second low portion of the cam defines a recess detent releasably receiving said cam follower.

8. The musical instrument structure of claim 1 wherein said cams comprise a plurality of formed resiliently deflectible fingers.

9. The musical instrument structure of claim 1 wherein said cams comprise a plurality of formed fingers mounted to said carrier in a side-by-side series.

10. The musical instrument structure of claim 1 wherein said cams comprise unitarily integral portions of a common carrier.

* * * * *